US008177529B2

(12) United States Patent
Jeong et al.

(10) Patent No.: US 8,177,529 B2
(45) Date of Patent: May 15, 2012

(54) RECIPROCATING COMPRESSOR

(75) Inventors: Sang-Sub Jeong, Seoul (KR); Won-Sik Oh, Seoul (KR); Hyuk Lee, Seoul (KR)

(73) Assignee: LG Electronics, Inc., Seoul (KR)

( * ) Notice: Subject to any disclaimer, the term of this patent is extended or adjusted under 35 U.S.C. 154(b) by 845 days.

(21) Appl. No.: 12/216,159

(22) Filed: Jun. 30, 2008

(65) Prior Publication Data

US 2009/0116983 A1 May 7, 2009

(30) Foreign Application Priority Data

Nov. 1, 2007 (KR) ..... 10-2007-0111172

(51) Int. Cl.
*F04B 17/04* (2006.01)

(52) U.S. Cl. ..... 417/416; 417/417; 417/902; 310/13; 310/15

(58) Field of Classification Search ..... 417/415, 417/416, 417, 902; 310/12.24, 12.25, 12.26, 310/13, 14, 15, 17, 28, 23
See application file for complete search history.

(56) References Cited

U.S. PATENT DOCUMENTS

| | | | | |
|---|---|---|---|---|
| 5,727,388 | A * | 3/1998 | Adamides | 60/417 |
| 7,537,438 | B2 * | 5/2009 | Song et al. | 417/417 |
| 2005/0135954 | A1 * | 6/2005 | Saiki et al. | 417/572 |
| 2005/0207918 | A1 * | 9/2005 | Lee | 417/416 |
| 2005/0214140 | A1 * | 9/2005 | Lee et al. | 417/416 |
| 2005/0281691 | A1 * | 12/2005 | Lee | 417/417 |
| 2007/0132321 | A1 * | 6/2007 | Park et al. | 310/15 |
| 2007/0148018 | A1 * | 6/2007 | Her | 417/417 |

FOREIGN PATENT DOCUMENTS

| | | |
|---|---|---|
| KR | 10-2001-0111213 | 12/2001 |
| KR | 10-2003-0032551 | 4/2003 |
| KR | 10-2004-0091360 | 10/2004 |

* cited by examiner

*Primary Examiner* — Charles Freay
*Assistant Examiner* — Todd D Jacobs
(74) *Attorney, Agent, or Firm* — McKenna, Long and Aldridge, LLP.

(57) ABSTRACT

In a compressor, a motor includes a stator and a moving member that reciprocates. A frame supports the stator and a conductivity member flows at least a portion of magnetic flux flowing away from the stator back to the stator. Accordingly, the reciprocating compressor has enhanced energy efficiency.

12 Claims, 6 Drawing Sheets

RECIPROCATING COMPRESSOR

RELATED APPLICATION

The present application claims priority to Korean Application No. 10-2007-0111172, filed on Nov. 1, 2007, which is herein expressly incorporated by reference in its entirety.

BACKGROUND

1. Field of the Disclosure

The present disclosure relates to a reciprocating compressor including a motor, and more particularly, to a reciprocating compressor that prevents reduced efficiency due to magnetic loss by reducing an amount of magnetic flux leaked to a cylinder from a stator through a frame and by inducing the leaked magnetic flux back to the motor.

2. Background

Generally, a reciprocating compressor serves to suck, compress, and discharge a refrigerant as a piston linearly reciprocates in a cylinder. The reciprocating compressor may be classified into a connection type reciprocating compressor and a vibration type reciprocating compressor according to a driving method of the piston. In the connection type reciprocating compressor, the piston reciprocates in the cylinder while connected to a connection rod which is connected to a rotation shaft of a rotation motor, thereby compressing the refrigerant. On the other hand, in the vibration type reciprocating compressor, the piston reciprocates in the cylinder and vibrates while connected with a mover of a reciprocating motor, thereby compressing a refrigerant. Hereinafter, for disclosure purposes only, the vibration type reciprocating compressor will be referred to as a reciprocating compressor in the passages below.

The reciprocating compressor usually comprises a reciprocating motor including an outer stator, an inner stator, and a mover that reciprocates and is disposed between the two stators; a cylinder inserted into the inner stator of the reciprocating motor and fixed to a frame, or fixedly inserted into the inner stator; a piston coupled to the mover, for compressing a refrigerant while the mover reciprocates in the cylinder; and resonant springs disposed at front and rear sides of the piston, for inducing a relative motion of the piston with respect to the cylinder by resonating a reciprocation of the reciprocating motor. A suction passage for passing sucked refrigerant is formed in the piston. A suction valve is disposed at the end of the suction passage (or the piston), and a discharge valve is disposed at the fore end of the cylinder.

In the conventional reciprocating compressor, as the piston reciprocates with respect to the cylinder using a driving force generated by the reciprocating motor, the refrigerant is sucked, compressed, and then discharged. The above process is repeatedly performed.

In the conventional reciprocating motor, the frame is formed of aluminum, a non-magnetic substance to minimize a leakage amount of magnetic flux. However, since aluminum has conductivity, magnetic flux may be leaked to the cylinder due to eddy current of the frame. Accordingly, the efficiency of the reciprocating motor and the reciprocating compressor having the same may be lowered.

SUMMARY

Therefore, the present disclosure discloses embodiments of a reciprocating compressor capable of preventing lowered efficiency due to magnetic loss by reducing an amount of magnetic flux leaked to a cylinder from a stator through a frame, and by inducing the leaked magnetic flux to a motor.

To achieve these and other advantages and in accordance with the purpose of the present disclosure, as embodied and broadly described herein, in one embodiment, there is provided a reciprocating compressor, comprising: a reciprocating motor including a first stator and a second stator separated to have an air gap there between, and a mover disposed between the first stator and the second stator, and to perform a reciprocation; a frame to support the first and second stators; and a magnetic flux guiding member disposed between at least one of the first stator and the second stator and the frame, to guide magnetic flux.

The foregoing and other objects, features, aspects and advantages of the present disclosure will become more apparent from the following detailed description of the present disclosure when taken in conjunction with the accompanying drawings.

BRIEF DESCRIPTION OF THE DRAWINGS

The accompanying drawings, which are included to provide a further understanding of the disclosure and are incorporated in and constitute a part of this specification, illustrate embodiments of the invention and together with the description serve to explain the principles of the invention.

In the drawings.

DETAILED DESCRIPTION OF THE EMBODIMENTS

Reference will now be made in detail to the preferred embodiments of the present disclosure, examples of which are illustrated in the accompanying drawings.

Hereinafter, embodiments of a reciprocating compressor will be explained in more detail with reference to the attached drawings.

Figure 1:
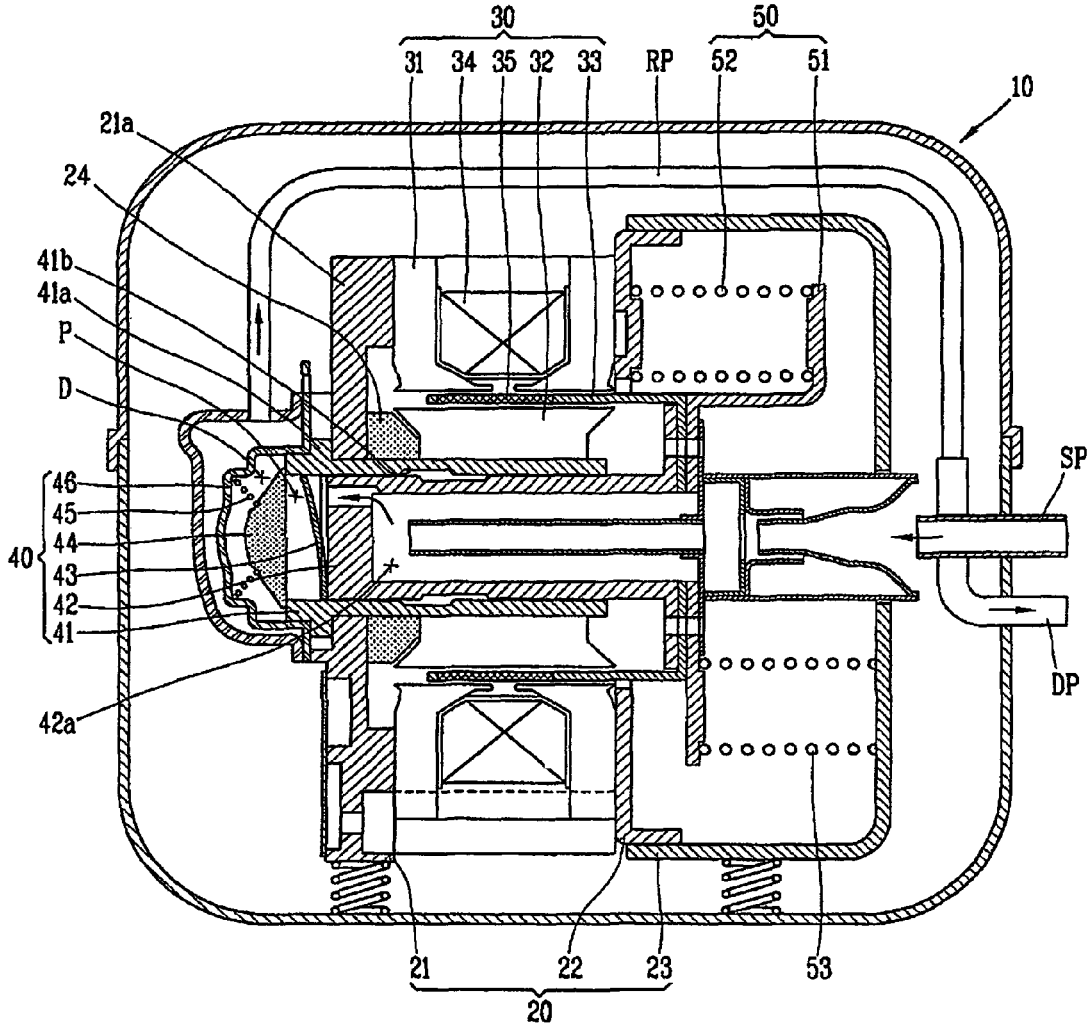
FIG. 1 is a longitudinal section view showing a reciprocating compressor according to one embodiment of the present invention.

FIG. 1 is a sectional view showing a reciprocating compressor according to one embodiment of the present invention.

As shown in FIG. 1, the reciprocating compressor comprises a casing 10 to which a gas suction pipe SP and a gas discharge pipe DP are connected, a frame unit 20 elastically supported in the casing 10, a reciprocating motor 30 supported by the frame unit 20 for linearly reciprocating a mover 33 to be later explained, a compression unit 40 supported by the frame unit 20 that includes a piston 42, to be later explained, coupled to the mover 33 of the reciprocating motor 30, and a plurality of resonant units 50 for inducing a resonant motion of the piston 42 by elastically supporting the mover 33 of the reciprocating motor 30 and the piston 42 of the compression unit 40 in a moving direction of the piston 42.

The frame unit 20 includes a first frame 21 supporting the compression unit 40 and a front side of the reciprocating motor 30, a second frame 22 coupled to the first frame 21 for supporting a rear side of the reciprocating motor 30, and a third frame 23 coupled to the second frame 22 for supporting a plurality of second resonant springs 53 to be later explained.

Each of the first to third frames 21, 22 and 23 may be formed of a non-magnetic substance such as aluminum to reduce magnetic loss.

Figure 2:
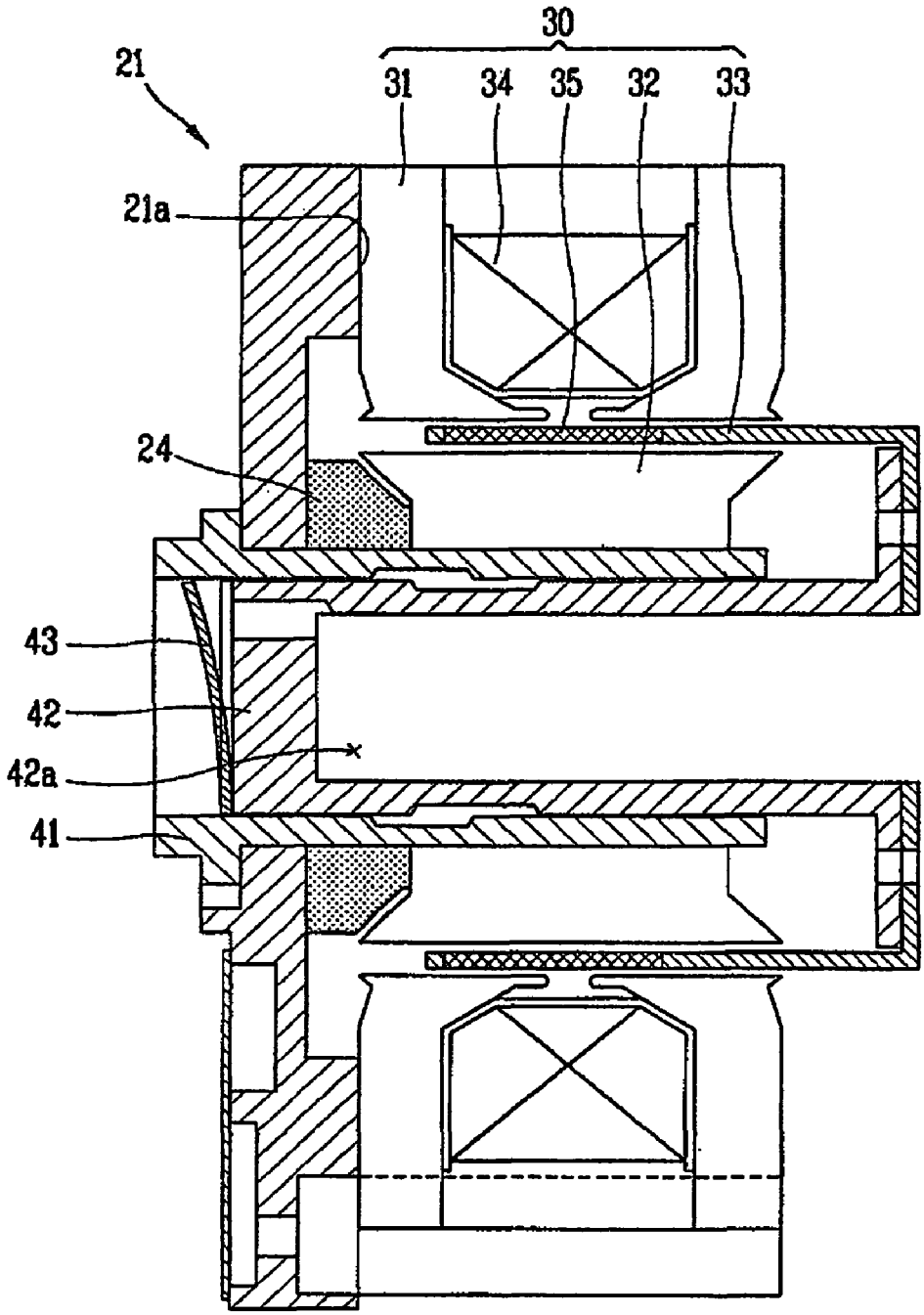
FIG. 2 is an enlarged longitudinal section view showing a coupled state among a frame unit, a reciprocating motor, and a compression unit of the reciprocating compressor of FIG. 1.
Figure 3:
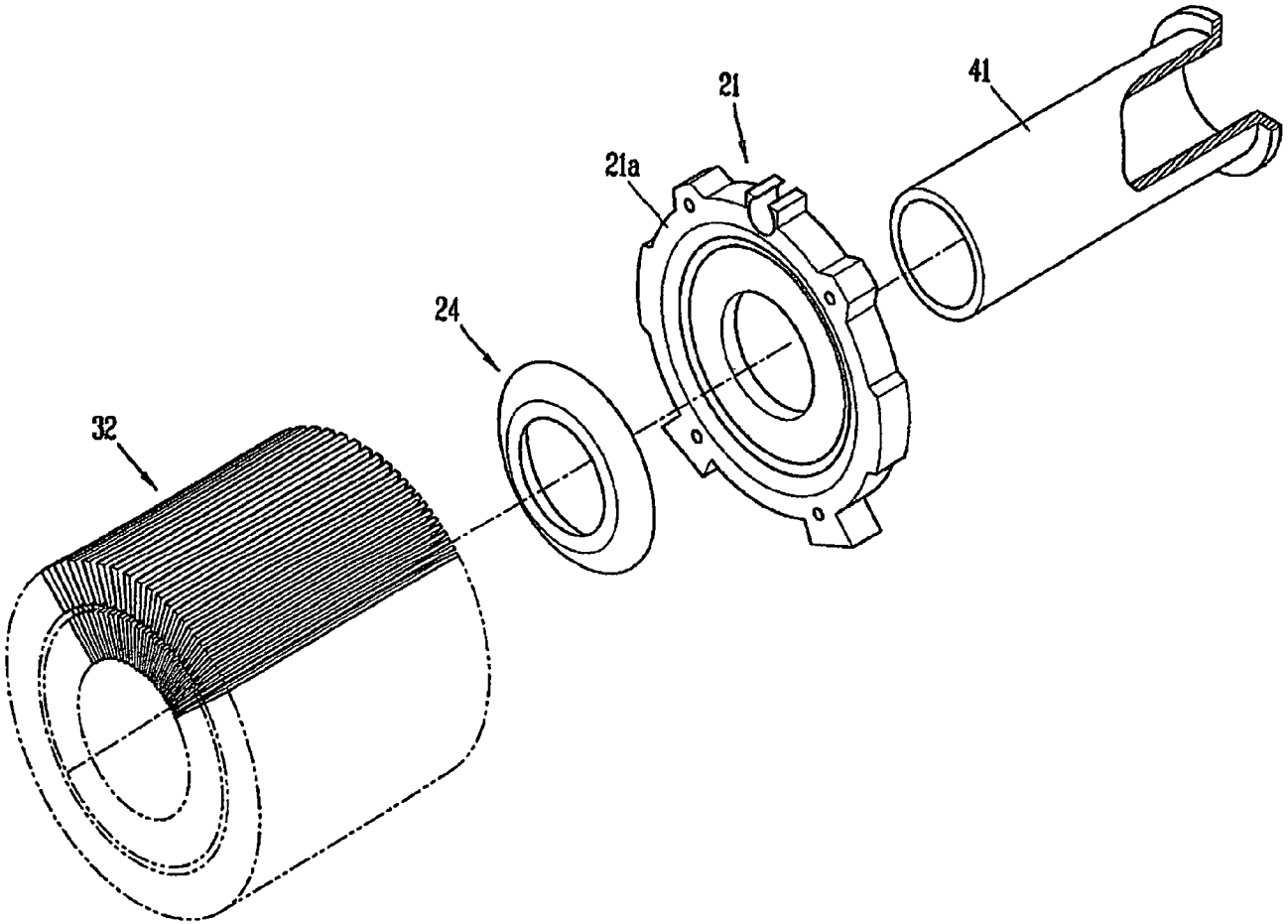
FIG. 3 is an exploded perspective view showing the frame unit, the reciprocating motor, and a cylinder of the reciprocating compressor of FIG. 1.

Referring to FIGS. 1 to 3, the first frame 21 is formed to have a ring shape, and is provided with a fixing protrusion 21*a* having a cylindrical shape for supporting a front surface of an outer stator 31 at a rear surface, i.e., at one side surface where the reciprocating motor 30 is supported. A central portion of the first frame 21 is formed to be flat such that a magnetic flux guiding member 24, to be later explained, may be adhered thereto.

The magnetic flux guiding member 24 may be formed to have a circular shape or an arc shape. The magnetic flux guiding member 24 may be formed to have a tapered section so that an outer circumferential surface thereof may have a sectional area that gradually narrows towards the inner stator 32 at an inner surface of the first frame 21.

In order to support the front surface of the inner stator 32 using one side surface of the magnetic flux guiding member 24, the magnetic flux guiding member 24 may have a shape similar to that of the front surface of the inner stator 32. Accordingly, as shown in FIGS. 2 and 3, the magnetic flux guiding member 24 may be formed to have a tapered sectional area. The magnetic flux guiding member 24 may be also formed to have the same sectional area according to the shape of the inner stator 32.

Figure 4:
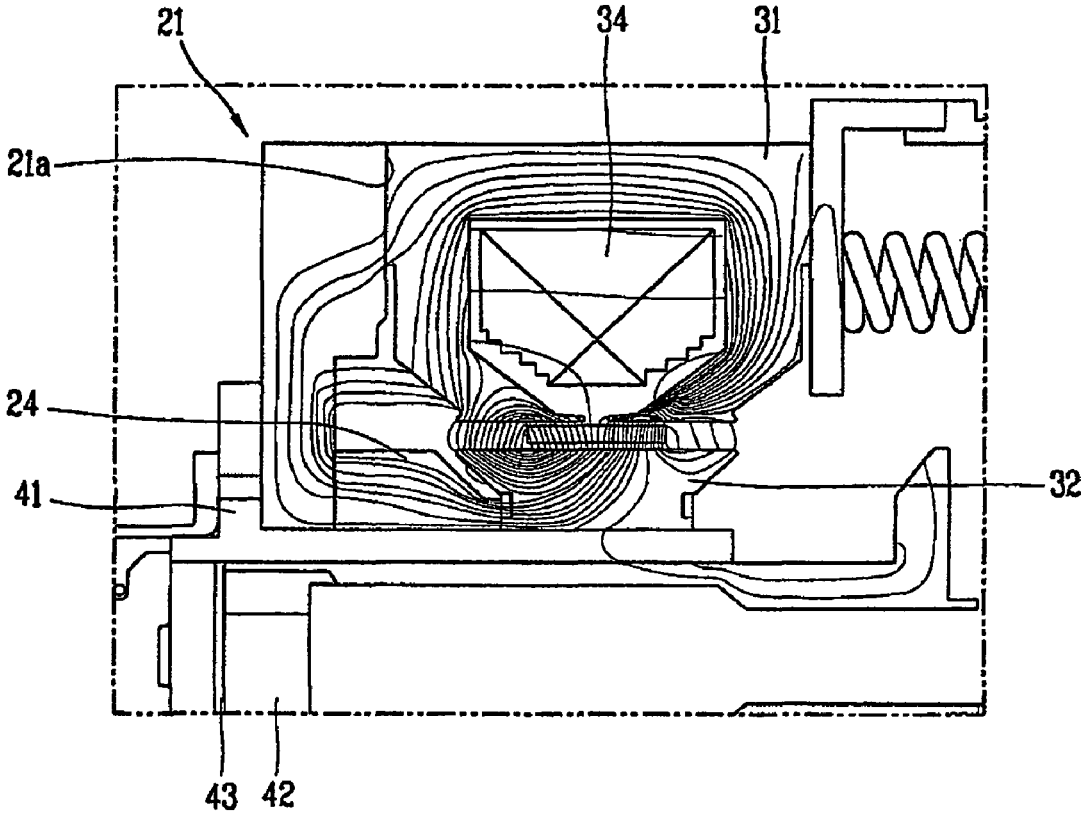
FIG. 4 is a schematic view showing the reciprocating compressor having a magnetic flux guiding member in which magnetic flux leaked to a first frame is guided to the reciprocating motor in the reciprocating compressor of FIG. 1.

As shown in FIG. 4, the magnetic flux guiding member 24 is preferably formed of a material having conductivity higher than that of the first frame 21 such that magnetic flux leaked to the first frame 21 is induced to the inner stator 32. Both the first frame 21 and the magnetic flux guiding member 24 may be formed of duralumin. Also, the first frame 21 may be formed of ingot aluminum, whereas the magnetic flux guiding member 24 may be formed of duralumin. However, it is preferable that the first frame 21 is formed of ingot aluminum and the magnetic flux guiding member 24 is formed of copper considering conductivity and fabrication cost.

For a smooth induction of magnetic flux, the magnetic flux guiding member 24 is preferably formed to have a thickness corresponding to at least ⅓ of a thickness of the first frame 21.

When the magnetic flux guiding member 24 is formed of the same material as the first frame 21, the magnetic flux guiding member 24 may be integrally formed with the first frame 21. However, when the magnetic flux guiding member 24 is formed of a different material from the first frame 21, the magnetic flux guiding member 24 may be integrally formed with the first frame 21 by using a method such as an insert die casting method.

Figure 5:
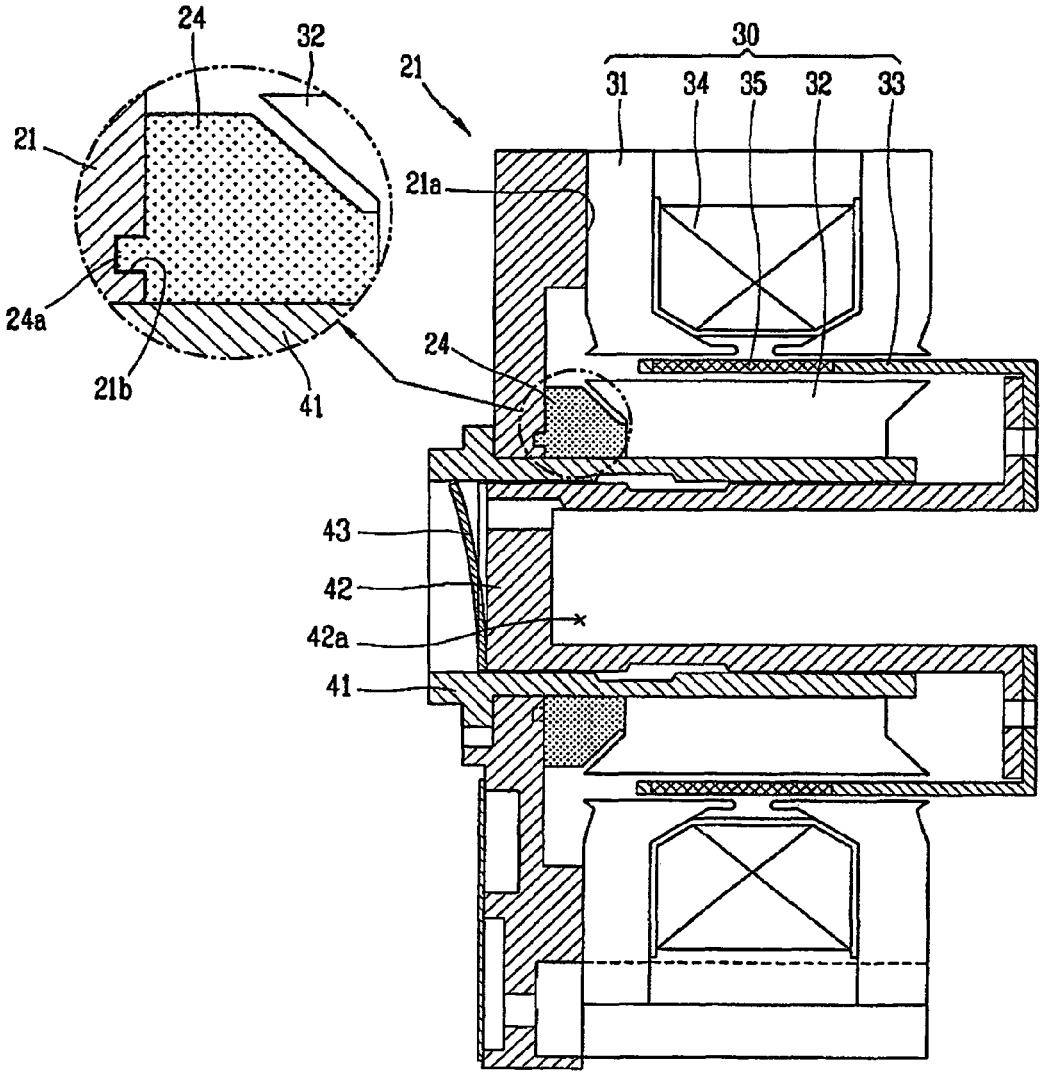
FIGS. 5 and 6 are longitudinal section views showing other embodiments of a reciprocating compressor, which respectively show a structure to easily set an assembly position of a magnetic flux guiding member to the reciprocating compressor, the structure which is applied when the magnetic flux guiding member is separately formed to be assembled to the reciprocating compressor.

The magnetic flux guiding member 24 may be individually formed from the first frame 21 and assembled to the first frame 21. As shown in FIG. 5, in order to couple the magnetic flux guiding member 24 in proper position with respect to the first frame 21, an aligning protrusion 24*a* and an aligning recess 21*b* may be formed to face each other at the respective magnetic flux guiding member 24 and the first frame 21. When the reciprocating motor 20 applies force in the reciprocating compressor, an oil passage, etc. may be formed at the magnetic flux guiding member 24 and the first frame 21. Thus, it is desirable to assemble the magnetic flux guiding member 24 in proper position to the first frame 21 so as to simplify an entire assembly process.

Figure 6:
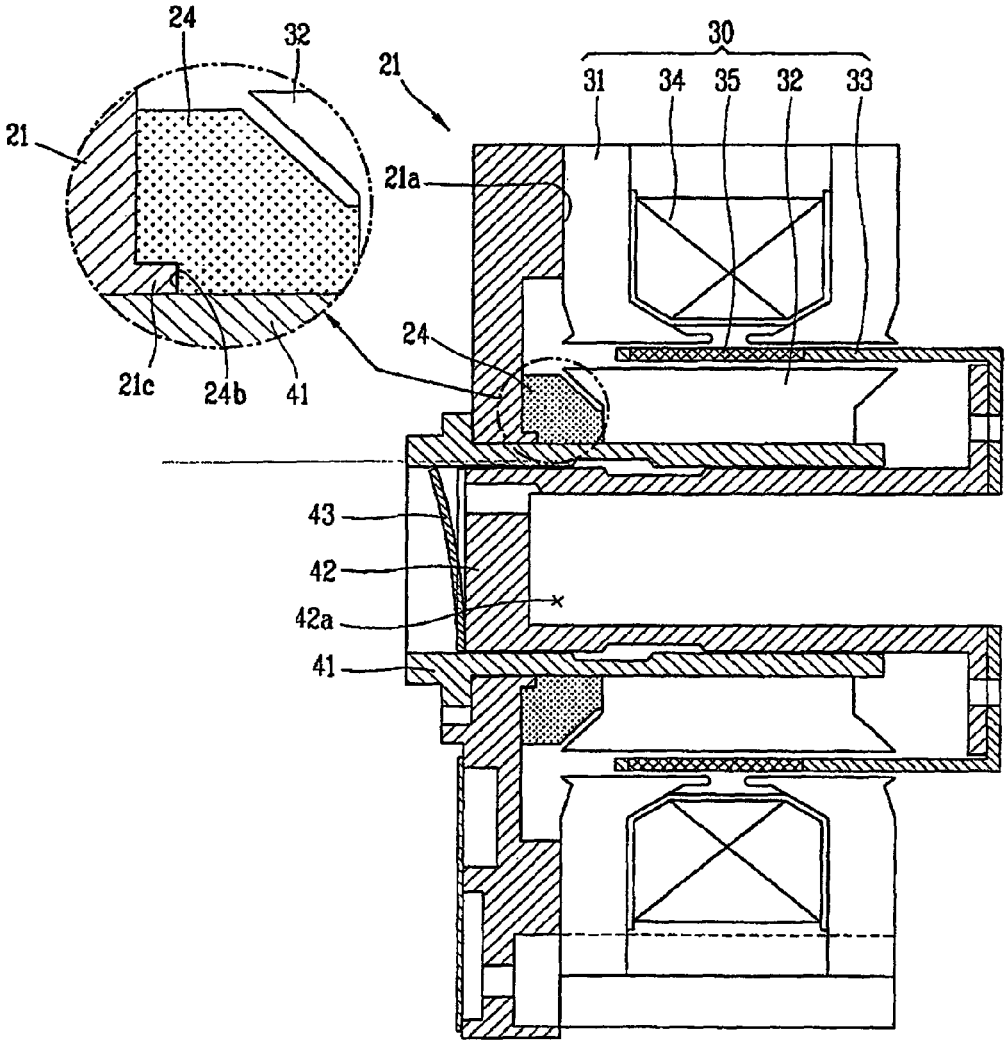

As shown in FIG. 6, an insertion protrusion 21*c* having a ring shape may be formed at the first frame, and an insertion recess 24*b* having a ring shape for inserting the insertion protrusion 21*c* of the first frame 21 may be formed at one side of the magnetic flux guiding member 24. Accordingly, the magnetic flux guiding member 24 may be coupled in proper position to the first frame 21.

The reciprocating motor 30 includes a first stator 31 (hereinafter, will be referred to as an outer stator) supported between the first frame 21 and the second frame 22, and having a coil 34 wound thereon; a second stator 32 (hereinafter, will be referred to as an inner stator) coupled to inside of the outer stator 31 with a certain gap, into which a cylinder 41, to be later explained, is inserted; and a mover 33 having a magnet 35 in correspondence to the coil 34 of the outer stator 31, and linearly reciprocating between the outer stator 31 and the inner stator 32 according to alternating magnetic flux generated by the reciprocating motor 30. The outer stator 31 and the inner stator 32 are formed with a plurality of thin stator cores laminated in a cylindrical shape, or with a plurality of stator blocks radially laminated to each other. Here, each of the stator blocks is formed as a plurality of thin stator cores laminated in a block shape.

The compression unit 40 includes a cylinder 41 integrally formed at the first frame 21 or individually formed to be inserted into the first frame 21; a piston 42 coupled to the mover 33 of the reciprocating motor 30, and performing a reciprocation in a compression space P of the cylinder 41; a suction valve 43 mounted at a fore end of the piston 42, for controlling suction of refrigerant gas by opening and closing a suction passage 42*a* of the piston 42; a discharge valve 44 disposed at a discharge side of the cylinder 41, for controlling discharge of compressed gas by opening and closing the compression space P of the cylinder 41; a valve spring 45 for elastically supporting the discharge valve 44; and a discharge cover 46 fixed to the first frame 21 at the discharge side of the cylinder 41, to cover the discharge valve 44 and to receive the valve spring 45.

Each of the resonant units 50 includes a spring supporter 51 coupled to a connection portion between the mover 33 and the piston 42, first resonant springs 52 supported at a front side of the spring supporter 51, and second resonant springs 53 supported at a rear side of the spring supporter 51.

An unexplained reference numeral D denotes a discharge space.

When magnetic flux is formed between the outer stator 31 and the inner stator 32 as power is supplied to the reciprocating motor 30, the mover 33 disposed at an air gap between the outer stator 31 and the inner stator 32 is resonated by the resonant unit 50 while moving according to the alternating magnetic flux generated by the reciprocating motor 30. When the piston 42 moves backward in the cylinder 41, refrigerant inside the casing 10 is sucked into the compression space P of the cylinder 41 via the suction passage 42*a* of the piston 42 and the suction valve 43. When the piston 42 moves forward in the cylinder 41, the refrigerant sucked into the compression space P is compressed and then is discharged as the discharge valve 44 is opened. The above process is repeatedly performed.

Here, the magnetic flux generated from the reciprocating motor 30 has to be applied only between the outer stator 31 and the inner stator 32 so as to enhance efficiency of the reciprocating motor. However, the first frame 21, the cylinder 41, etc., are disposed at a peripheral portion of the outer stator 31 and the inner stator 32. In order to enhance the efficiency of the reciprocating motor 30, a leakage amount of the magnetic flux generated from the reciprocating motor 30 to the cylinder 41 through the first frame 21 has to be minimized. Thus, as an example, at a contact portion between the first frame 21 and the inner stator 32, that is, at an inner side of the first frame 21, the magnetic flux guiding member 24 having conductivity higher than that of the first frame 21 is disposed. Accordingly, the magnetic flux leaked to the first frame 21 is guided to the inner stator 32 by the magnetic flux guiding member 24, thereby reducing an amount of leakage of the magnetic flux to the cylinder 41 due to eddy current. As a result, iron loss of the reciprocating motor is reduced, and the reciprocating compressor having the reciprocating motor has enhanced efficiency.

When the first frame 21 is formed of ingot aluminum and the magnetic flux guiding member 24 is formed of copper, iron loss and iron loss resistance are respectively reduced by approximately 22% and 2Ω than in a case when both the first frame 21 and the magnetic flux guiding member 24 are formed of ingot aluminum. Accordingly, energy efficiency (EER) of the reciprocating motor is enhanced by approximately 0.06%.

When the first frame 21 and the magnetic flux guiding member 24 are respectively formed of ingot aluminum and copper, magnetic loss due to magnetic flux generated only by the magnet, so called 'shuttle loss' is reduced by approximately 91.3%. Accordingly, the energy efficiency (EER) of the reciprocating motor is enhanced by approximately 0.03%.

Furthermore, in the reciprocating motor, when the first frame 21 and the magnetic flux guiding member 24 are respectively formed of ingot aluminum and copper, an AC resistance (Rac) is reduced by approximately 1.83Ω than a case when the first frame 21 and the magnetic flux guiding member 24 are respectively formed of ingot aluminum. Accordingly, the energy efficiency (EER) of the reciprocating compressor is enhanced by approximately 0.07%.

As aforementioned, in the reciprocating compressor according to the embodiments, the frame that supports two stators having a magnet there between is formed of aluminum, and copper is disposed at a contact member between the frame and the stator. Accordingly, iron loss leaked from the stator to the adjacent member such as the cylinder is reduced, and shuttle loss is reduced by preventing magnetic flux from being applied to the cylinder from the first frame. As a result, the reciprocating motor and the reciprocating compressor having the same may have enhanced energy efficiency, respectively.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A reciprocating compressor, comprising:

a reciprocating motor including a first stator and a second stator separated to have an air gap there between, and a mover disposed between the first stator and the second stator, to perform a reciprocation;

a frame to support the first and second stators;

a cylinder coupled to the frame, inserted in the second stator, and forming a compression space therein;

a piston inserted into the compression space of the cylinder to perform a reciprocation, and connected to the mover; and a magnetic flux guiding member disposed between a front surface of the second stator and a rear surface of the frame facing the front surface of the second stator in the reciprocation direction of the mover, to guide magnetic flux, wherein one side surface of the magnetic flux guiding member contacts the second stator in the reciprocation direction of the mover, and another side surface of the magnetic flux guiding member contacts one side surface of the frame in the reciprocation direction of the mover, wherein an entirety of an innermost radial surface of the second stator is in direct contact with the cylinder, and wherein the magnetic flux guiding member is formed of a material having conductivity higher than that of the frame.

2. The reciprocating compressor of claim 1, wherein the magnetic flux guiding member is formed of a material having conductivity higher than that of the frame.

3. The reciprocating compressor of claim 1, wherein the frame is formed of aluminum, and the magnetic flux guiding member is formed of copper.

4. The reciprocating compressor of claim 1, wherein the magnetic flux guiding member is formed to have a thickness corresponding to at least ⅓ of a thickness of the frame.

5. The reciprocating compressor of claim 1, wherein the magnetic flux guiding member is formed to have a same or similar shape as a corresponding surface of the second stator.

6. The reciprocating compressor of claim 1, wherein the magnetic flux guiding member is integrally formed with the frame.

7. The reciprocating compressor of claim 1, wherein the magnetic flux guiding member is separately formed from the frame, and is assembled to the frame.

8. The reciprocating compressor of claim 1, wherein one or more aligning protrusions or aligning recesses are formed at one side surface of the magnetic flux guiding member and one or more corresponding aligning recesses or aligning protrusions are formed at one side surface of the frame so as to be engaged to each other.

9. A compressor, comprising:

a motor including a first stator and a second stator separated to have an air gap there between, and a mover disposed between the first stator and the second stator, to perform reciprocation;

a frame to support the first and second stators;

a cylinder coupled to the frame, inserted in the second stator, and forming a compression space therein;

a piston inserted into the compression space of the cylinder to perform a reciprocation, and connected to the mover; and a conductivity member having conductivity higher than the frame to guide magnetic flux, wherein one side surface of the conductivity member in the reciprocation direction of the mover contacts a front surface of the second stator, and another side surface of the conductivity member in the reciprocation direction of the mover contacts a rear surface of the frame facing the front surface of the second stator, and wherein an entirety of an innermost radial surface of the second stator is in direct contact with the cylinder.

10. The compressor of claim 9, wherein the frame is formed with aluminum and the conductivity member is formed with copper.

11. The compressor of claim 9, wherein the frame is formed with ingot aluminum and the conductivity member is formed with duralumin

12. The compressor of claim 9, wherein the conductivity member is formed to have a same or similar shape as a corresponding surface of the second stator.

* * * * *